US008506109B2

(12) United States Patent
Stukenberg et al.

(10) Patent No.: US 8,506,109 B2
(45) Date of Patent: Aug. 13, 2013

(54) DISPLAY TABLE WITH LIGHT DRAWER

(75) Inventors: Joseph R. Stukenberg, Minneapolis, MN (US); Robert W. Leesmann, Washington, MO (US)

(73) Assignee: Target Brands, Inc., Minneapolis, MN (US)

( * ) Notice: Subject to any disclaimer, the term of this patent is extended or adjusted under 35 U.S.C. 154(b) by 186 days.

(21) Appl. No.: 13/268,244

(22) Filed: Oct. 7, 2011

(65) Prior Publication Data

US 2013/0087081 A1 Apr. 11, 2013

(51) Int. Cl.

| | |
|---|---|
| ***A47B 23/06*** | (2006.01) |
| ***A47B 97/00*** | (2006.01) |
| ***F21V 33/00*** | (2006.01) |

(52) U.S. Cl.

USPC ..... 362/132; 362/33

(58) Field of Classification Search

USPC ..... 362/33, 127–144, 154–155, 253, 362/458

See application file for complete search history.

(56) References Cited

U.S. PATENT DOCUMENTS

| | | | |
|---|---|---|---|
| 810,243 | A | 1/1906 | Wright |
| 839,639 | A | 12/1906 | Pulper |
| 870,314 | A | 11/1907 | Pierce |
| 1,435,395 | A | 11/1922 | Howard |
| 1,528,243 | A | 6/1923 | Briggs |
| 1,766,409 | A | 9/1927 | Stocks |
| 1,647,889 | A | 11/1927 | Saunders |
| 1,846,878 | A | 2/1932 | Kopp |
| 1,854,104 | A | 4/1932 | Burkhart |
| 1,861,671 | A | 6/1932 | Webb |
| 1,951,242 | A | 3/1934 | Gray |
| 1,991,463 | A | 2/1935 | Mackasek |
| 2,114,460 | A | 4/1938 | Ziegler |
| 2,145,238 | A | 1/1939 | Falk |
| 2,171,378 | A | 8/1939 | Urbanek |
| 2,218,395 | A | 10/1940 | Hallbauer |
| 2,285,962 | A | 6/1942 | Foulkes |
| 2,355,731 | A | 8/1944 | James |
| 2,456,867 | A | 12/1948 | Costa |
| 3,716,281 | A | 2/1973 | Rudder, Jr. |
| 4,154,027 | A | 5/1979 | Searcy |
| 4,162,814 | A | 7/1979 | Garbero et al. |
| D255,407 | S | 6/1980 | Brittner |
| 4,288,948 | A | 9/1981 | Harris |
| 4,507,714 | A | 3/1985 | Aschinger et al. |
| D285,153 | S | 8/1986 | Davis |
| D307,083 | S | 4/1990 | Knudsen |
| D318,581 | S | 7/1991 | DiDomenico |
| D322,368 | S | 12/1991 | Blum |
| 5,125,726 | A | 6/1992 | Hahn et al. |
| D327,996 | S | 7/1992 | Warfield |
| D327,997 | S | 7/1992 | Rubin |

(Continued)

*Primary Examiner* — Jason Moon Han

(74) *Attorney, Agent, or Firm* — Griffiths & Seaton PLLC; JoAnn M. Seaton

(57) ABSTRACT

A display table includes a drawer section, a main drawer, an internal light drawer, and an upper section. The drawer section includes two opposing sidewalls partially defining a drawer compartment and a main opening. The main drawer, disposed within the drawer compartment, slidably mounts to the two opposing sidewalls and includes an exposed front panel for concealing the main opening. The internal light drawer is disposed above the main drawer and slidably couples to the two opposing sidewalls. The upper section is disposed over the drawer section to receive light when the internal light drawer is illuminated. When the main drawer is in an open position, the internal light drawer is movable relative to the main drawer. When the main drawer is in a closed position, the internal light drawer is concealed by the front panel.

24 Claims, 13 Drawing Sheets

(56) References Cited

U.S. PATENT DOCUMENTS

| | | | |
|---|---|---|---|
| D348,364 | S | 7/1994 | Engel |
| D351,075 | S | 10/1994 | Rubin et al. |
| D351,747 | S | 10/1994 | Rubin |
| D353,284 | S | 12/1994 | Greenwald |
| 5,457,615 | A | 10/1995 | Nezer |
| D373,689 | S | 9/1996 | Liadro Roig et al. |
| 5,722,747 | A | 3/1998 | Baron |
| D393,960 | S | 5/1998 | Geier et al. |
| D403,534 | S | 1/1999 | Gregory et al. |
| D408,654 | S | 4/1999 | Liberto |
| D426,984 | S | 6/2000 | Griffith |
| D435,182 | S | 12/2000 | Mason |
| D450,486 | S | 11/2001 | Stafford et al. |
| 6,425,647 | B1 | 7/2002 | Pothin |
| D534,372 | S | 1/2007 | Babbino et al. |
| D572,041 | S | 7/2008 | Woolnough et al. |
| D611,733 | S | 3/2010 | Stukenberg |
| D611,734 | S | 3/2010 | Stukenberg et al. |
| D611,735 | S | 3/2010 | Stukenberg |
| D622,084 | S | 8/2010 | Stukenberg et al. |
| D632,508 | S | 2/2011 | Levy et al. |
| 2007/0247835 | A1 | 10/2007 | Buelow, II et al. |

DISPLAY TABLE WITH LIGHT DRAWER

BACKGROUND OF THE INVENTION

Products are displayed in a variety of manners in retail environments. To enhance the display of smaller products, such as jewelry, display tables are used. The display tables can be used for drawing attention to the product. For example, the display tables can be decorated in an aesthetically pleasing manner to attract a customer to the display table. In other cases, the product can be placed alongside conspicuous indicia or signage. Display tables can also be used for displaying the product with other merchandise to increase sales.

SUMMARY OF THE INVENTION

One aspect of the present invention relates to a display table including a drawer section, a main drawer, an internal light drawer, and an upper section. The drawer section includes two opposing sidewalls partially defining a drawer compartment and a main opening. The main drawer, disposed within the drawer compartment, slidably mounts to the two opposing sidewalls and includes an exposed front panel for concealing the main opening. The internal light drawer is disposed above the main drawer and slidably couples to the two opposing sidewalls. The upper section is disposed over the drawer section to receive light when the internal light drawer is illuminated. When the main drawer is in an open position, the internal light drawer is movable relative to the main drawer. When the main drawer is in a closed position, the internal light drawer is concealed by the front panel.

BRIEF DESCRIPTION OF THE DRAWINGS

Embodiments of the invention will be described with respect to the figures, in which like reference numerals denote like elements, and in which.

DETAILED DESCRIPTION

The following detailed description of the invention provides examples and is not intended to limit the invention or the application and uses of the invention. Furthermore, there is no intention to be bound by any theory presented in the preceding background of the invention or the following detailed description of the invention.

A display table is provided for displaying product in an aesthetically pleasing, eye-catching manner. In one example, the display table includes an upper box that illuminates to provide additional light to draw attention to products on the display table. To maintain a visually appealing design, light components are disposed in an internal light drawer beneath the upper box. The internal light drawer is disposed over a main drawer for product and/or other storage, and both drawers are disposed behind a front panel to be hidden from view during product display. In addition, the internal light drawer can be manipulated independently from the main drawer to allow easy access to the lights during maintenance periods.

In particular, according to an embodiment, a display table includes a drawer section, a main drawer, an internal light drawer, and an upper section. The drawer section includes two opposing sidewalls partially defining a drawer compartment and a main opening. The main drawer, disposed within the drawer compartment, slidably mounts to the two opposing sidewalls and includes an exposed front panel for concealing the main opening. The internal light drawer is disposed above the main drawer and slidably couples to the two opposing sidewalls. The upper section is disposed over the drawer section to receive light when the internal light drawer is illuminated. When the main drawer is in an open position, the internal light drawer is movable relative to the main drawer. When the main drawer is in a closed position, the internal light drawer is concealed by the front panel.

Figure 1:
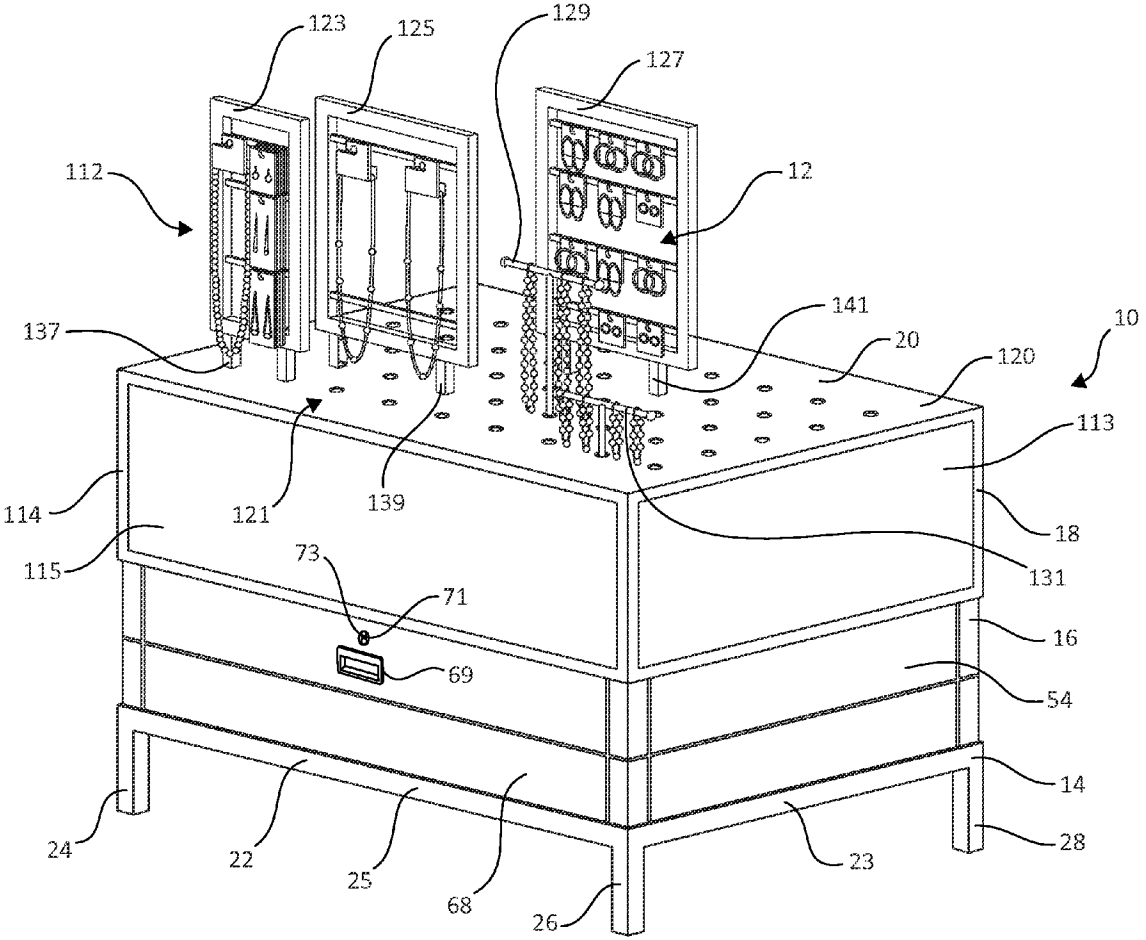
FIG. 1 is a front, perspective view illustration of a display table, display stands, and product, according to one embodiment of the present invention.
Figure 2:
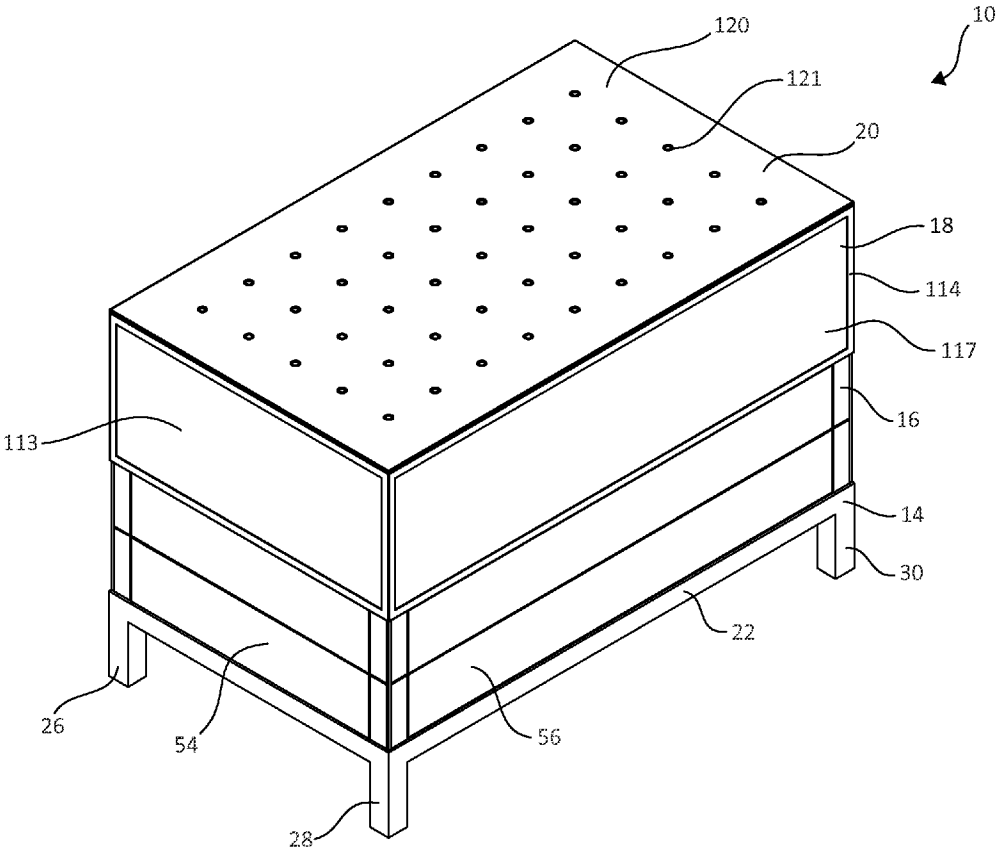
FIG. 2 is a rear, perspective view illustration of the display table of FIG. 1, according to one embodiment of the present invention.
Figure 3:
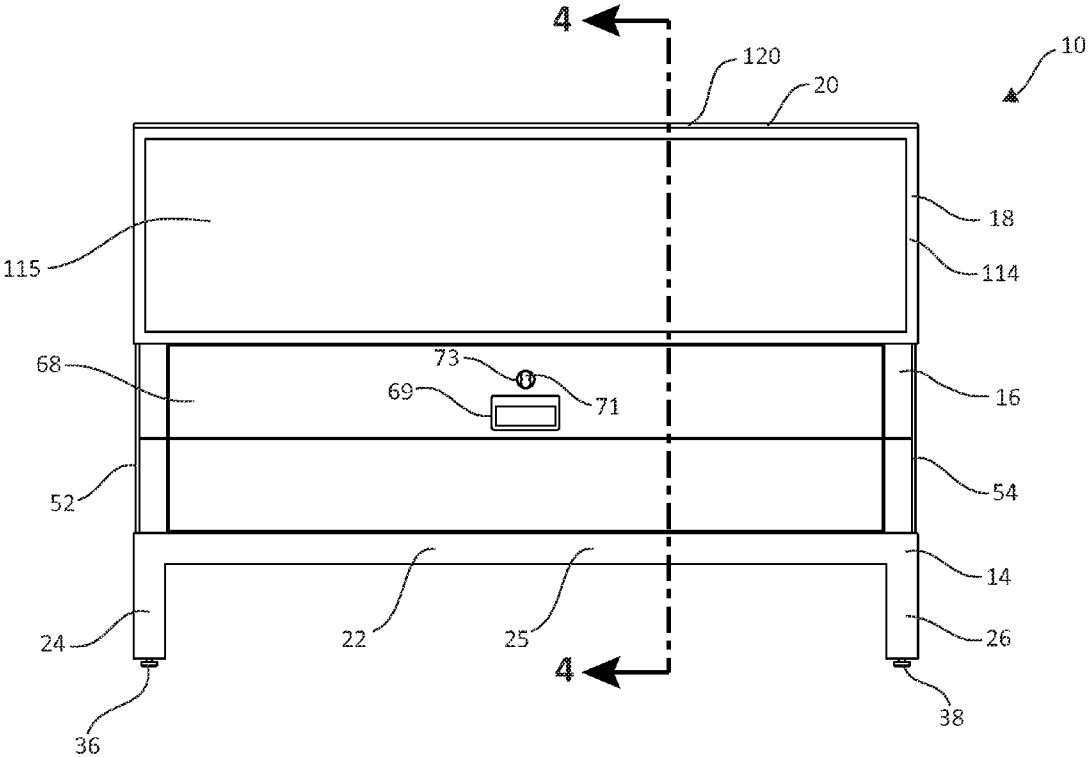
FIG. 3 is a front view illustration of a display table of FIG. 1, according to one embodiment of the present invention.

FIGS. 1-4 provide various views of an embodiment of a display table 10. Display table 10 is configured to provide illumination and to serve as a surface for displaying product 12 (FIG. 1). In an embodiment, display table 10 includes a platform or base 14, an intermediate section or drawer section 16, and an upper section 18. Drawer section 16 is disposed over base 14, and upper section 18 is disposed over drawer section 16. In an embodiment, upper section 18 has a top surface 20 for placement of product 12.

In one embodiment, to support drawer section 16 and upper section 18, base 14 comprises a support frame 22 and legs 24, 26, 28, and 30. Legs 24, 26, 28, and 30 extend from support frame 22 and elevate drawer section 16 a desired distance off the floor. With additional reference to FIGS. 5 and 6, support frame 22 has two opposing side rails 21 and 23, a front rail 25, and a back rail 27. Each of the two opposing side rails 21 and 23 extend between front rail 25 and back rail 27. In one example, rails 21, 23, 25, and 27 are arranged in a rectangle. Rails 21, 23, 25, and 27 define interior dimensions comprising an interior length (measured from an interior edge 31 of front rail 25 to an interior edge 33 of back rail 27) and an interior width (measured between interior edges 35 and 37 of opposing side rails 21 and 23, respectively) that are less than dimensions of a bottom surface 34 of drawer section 16. In this way, support frame 22 supports drawer section 16 on rails 21, 23, 25, and 27.

In one embodiment, rails 21, 23, 25, and 27 are arranged in a shape other than rectangular. Other suitable shapes include, but are not limited to ovular, circular, square, triangular, or another polygonal shape. Accordingly, more or fewer rails 21, 23, 25, and 27 are included as parts of support frame 22 depending on a desired support frame shape. Alternatively, support frame 22 does not include rails and, rather, comprises a planar structure (not illustrated). In such case, legs 24, 26, 28, and 30 extend from the planar support frame and are positioned to suitably support drawer section 16 and upper light section 18, and the planar support frame can have a length and width that is either greater or less than that of bottom surface 34 of drawer section 16.

Figure 5:
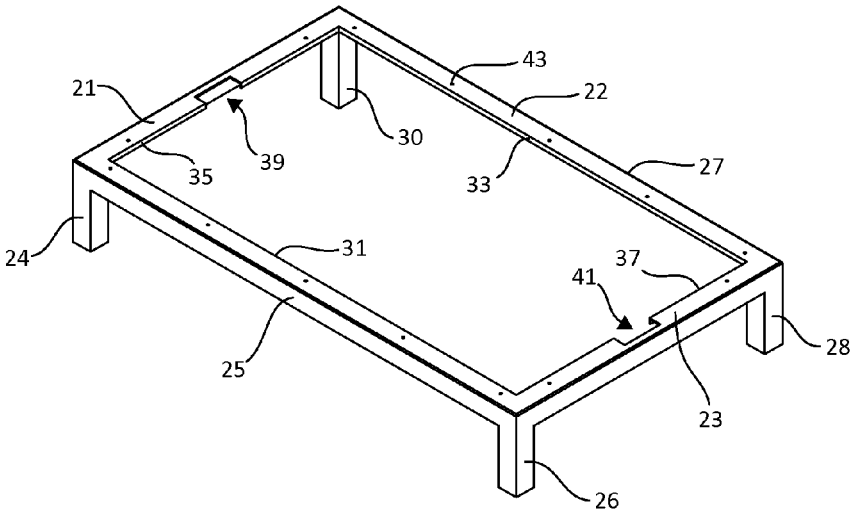
FIG. 5 is a top, perspective view illustration of a base of the display table of FIG. 2, according to one embodiment of the present invention.
Figure 6:
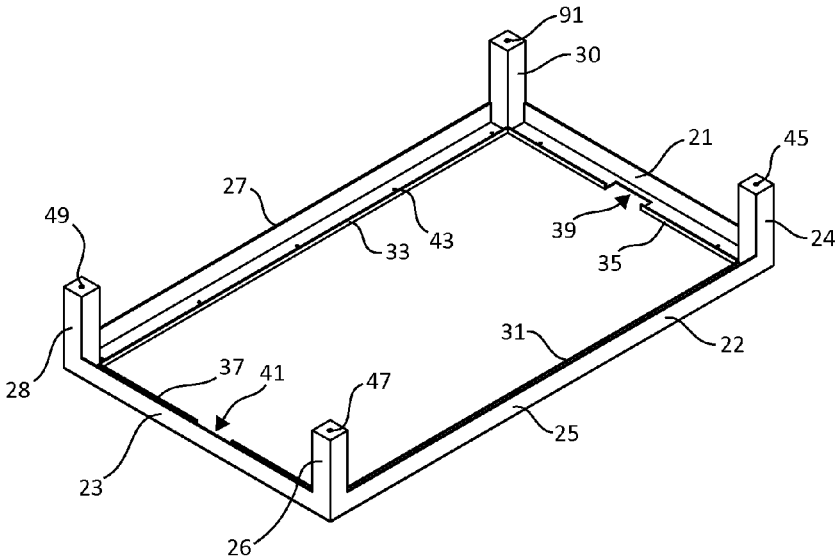
FIG. 6 is a bottom, perspective view of the base of FIG. 5, according to one embodiment of the present invention.

With additional reference to FIGS. 5 and 6, in one embodiment, to secure drawer section 16 to base 14, support frame 22 includes openings 43 formed in one or more rails 21, 23, 25, and 27. Openings 43 have threaded sidewalls for receiving fasteners, such as screws and the like, in an embodiment. In other embodiments, openings 43 receive bolts for bolting drawer section 16 to support frame 22.

Base 14 is formed of a material that provides structural integrity when supporting drawer section 16 and upper section 18. Suitable materials include, but are not limited to metals, such as aluminum, steel and the like, wood, plastic, and any other sturdy materials. Although base 14 is depicted as being formed as a single component (e.g., legs 24, 26, 28, and 30 and support frame 22 are formed of a single material), support frame 22 and legs 24, 26, 28, and 30 are formed as separate components in other embodiments. For example, support frame 22 is formed of wood or plastic, and legs 24, 26, 28, and 30 are formed of metal.

To improve stability of base 14, in one embodiment, each leg 24, 26, 28, and 30 includes a leg leveler 36, 38, and 91 (leveler for leg 30 is not shown). Each leg leveler 36, 38, and 40 has a stem that extends from a flat head. Each stem is inserted into a pre-drilled opening 45, 47, 49, and 51 in a corresponding leg 24, 26, 28, and 30. By adjusting a depth that each stem extends into a respective leg 24, 26, 28, and 30, the distance between the floor and base 14 can be adjusted.

Figure 4:
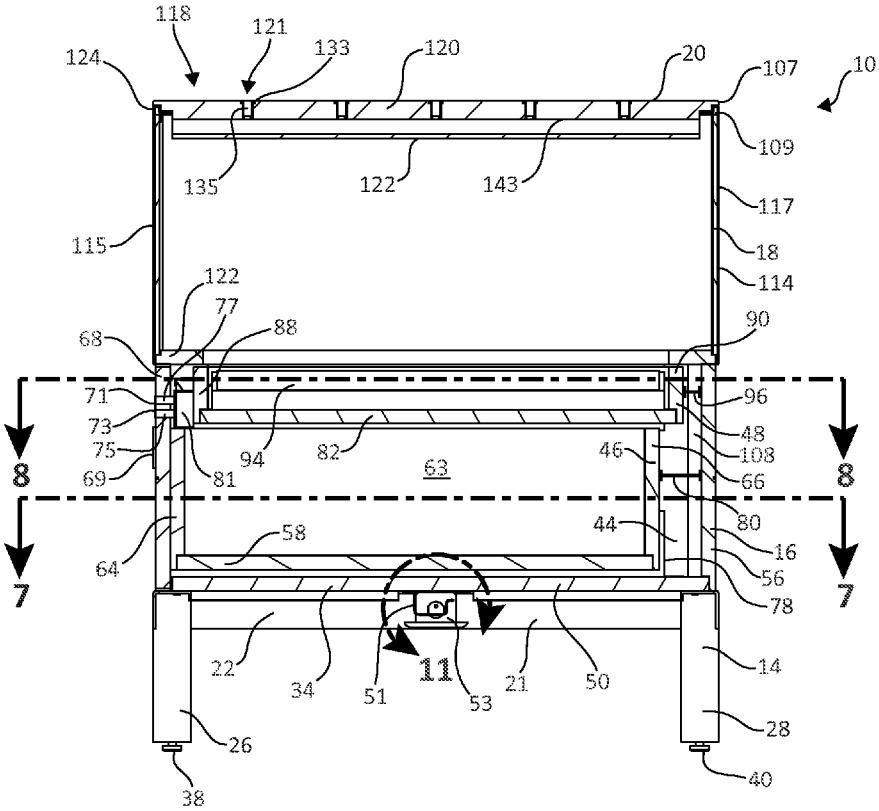
FIG. 4 is a cross-sectional view illustration of the display table of FIG. 3 taken along line 4-4, according to one embodiment of the present invention.
Figure 7:
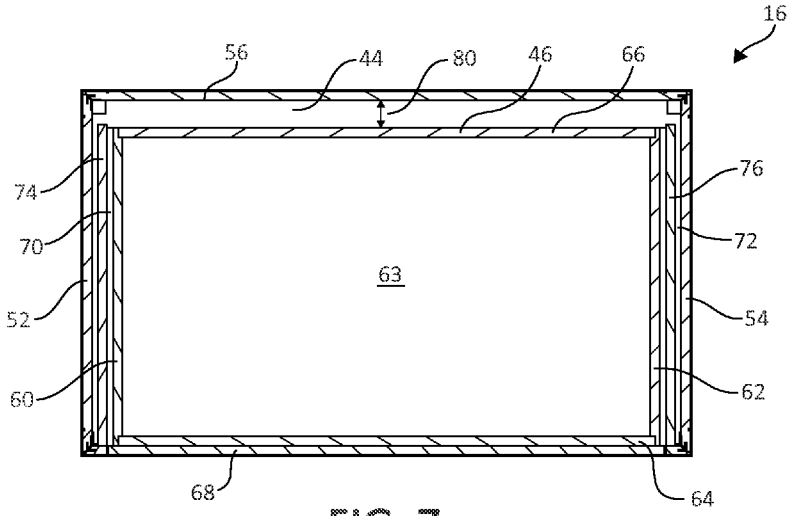
FIG. 7 is a cross-sectional view illustration of the display table of FIG. 4 taken along line 7-7, according to one embodiment of the present invention.
Figure 16:
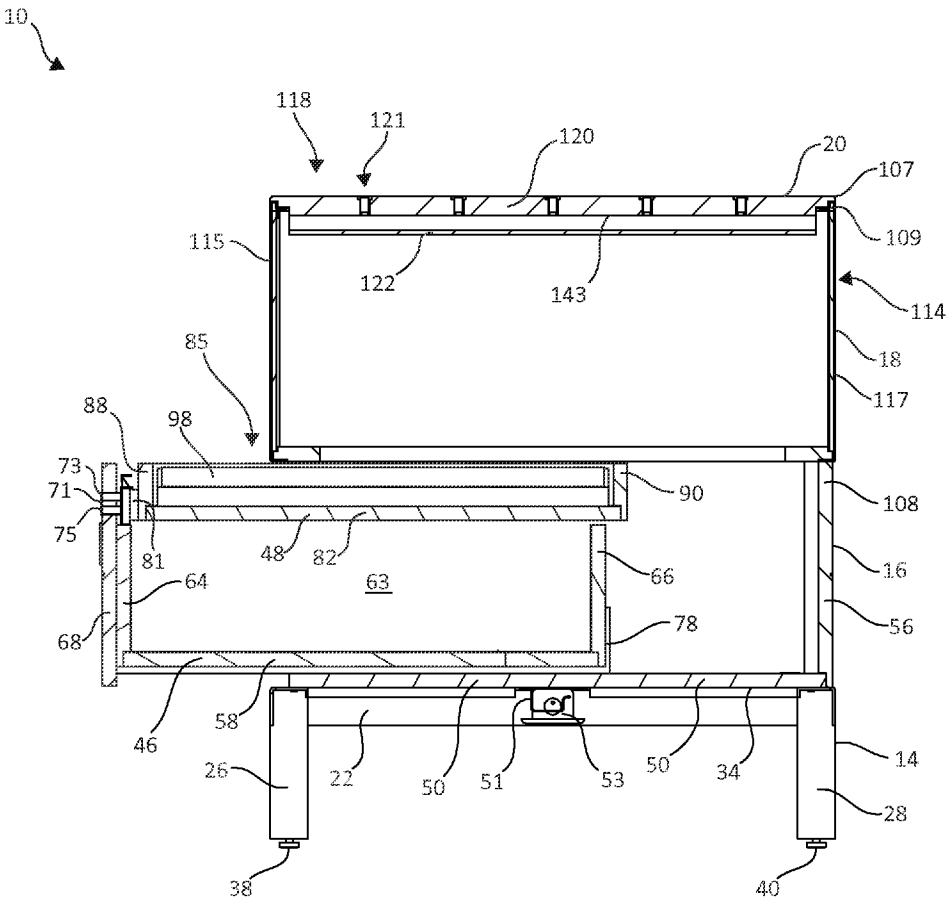
FIG. 16 is a cross-sectional view illustration of the display table of FIG. 3 taken along line 4-4 with a main drawer and an internal light drawer in an open position, according to one embodiment of the present invention.

With reference now to FIGS. 4 and 7, drawer section 16 includes a drawer compartment 44, a storage drawer or main drawer 46, and a light access drawer or internal drawer 48. Drawer compartment 44 encloses main drawer 46 and internal light drawer 48 to hide both drawers 46 and 48 from view when both are in a closed position as illustrated in FIG. 4. Drawer compartment 44 includes a main or front opening 85 (shown in FIGS. 16-18) and is defined by a bottom wall 50, opposing sidewalls 52 and 54, and back sidewall 56. Front opening 85 provides access to main drawer 46 and internal light drawer 48. Opposing sidewalls 52 and 54 and back sidewall 56 extend upwardly from bottom wall 50. Bottom wall 50 and sidewalls 52, 54, and 56 are molded as a single unit, in an embodiment. In another embodiment, bottom wall 50 and sidewalls 52, 54, and 56 are each separate panels that are assembled and held together with fasteners or adhesives. Bottom wall 50 and sidewalls 52, 54, and 56 are made from particle board, wood, plastic, or any other materials suitable for forming drawer compartment 44.

Main drawer 46 includes a bottom wall 58, two opposing sidewalls 60 and 62, a front wall 64, and a back wall 66. Bottom wall 58 defines a bottom surface of main drawer 46, and two opposing sidewalls 60 and 62, a front wall 64, and a back wall 66 extending upwardly from bottom wall 58 define a storage area 63 for product 12 and/or supplies. According to an embodiment, a separate exposed front panel 68 attaches to front wall 58 by, for example, fasteners or adhesive.

To substantially conceal main drawer 46 from view, exposed front panel 68 (or front wall 64, if front panel 68 is omitted) substantially covers front opening 85. In one example, exposed front panel 68 (or front wall 64) has dimensions that are larger than the dimensions of front opening 85 to entirely cover front opening 85. Alternatively, front panel 68 (or front wall 64) is substantially the same size as front opening 85. Front panel 68 (or front wall 64) can also have a shape that is substantially similar to that of front opening 35. In one example, front opening 85 is substantially rectangular and, hence, front panel 68 is substantially rectangular. In an embodiment in which front panel 68 (or front wall 64) is larger than front opening 85, front opening 85 and front panel 68 (or front wall 64) may be different in shape. For instance, front opening 85 can be substantially rectangular and front panel 68 can have an oval shape.

As alluded to above, main drawer 46 is movable between a closed position and various open positions. In this regard, main drawer 46 includes railing sets each having glides 70 and 72 and railings 74 and 76. In one embodiment, glides 70 and 72 attach to opposing sidewalls 60 and 62 and are slidably coupled to corresponding railings 74 are 76 attached to interior surfaces of drawer compartment sidewalls 52 are 54. Suitable types of glide/railing sets 70, 72, 74, and 76 include ball bearing railings, linear slide rails, rack slide rails, and the like. To prevent main drawer 46 from hyperextending, glide/railing sets 70, 72, 74, and 76 include mechanisms that lock when the railings are fully extended.

In one embodiment, drawer compartment 44 includes a stop mechanism 78 to obstruct movement of the main drawer 46 and to maintain a gap 80 between back wall 58 of main drawer 46 and back wall 56 of drawer compartment 44. A width of gap 80 measured between back wall 68 and back wall 56 ranges from a few millimeters to a few centimeters. Stop mechanism 78 couples to and extends upwardly from bottom wall 50 of drawer compartment 44 (as illustrated in FIG. 5), in an embodiment. In another embodiment, stop mechanism 78 couples to back wall 66 of main drawer 46 and extends toward back wall 56 of drawer component 34. In still another embodiment, stop mechanism 78 extends toward front opening 85 from back wall 56 of drawer component 34. Stop mechanism 78 can comprise one or more plates, rods, and the like.

To provide an improved grip surface when a user opens main drawer 46, front panel 68 includes a drawer pull 69. In one example, drawer pull 69 is disposed substantially on a top half of front panel 68 for convenience to the user. Drawer pull 69 can be friction fit inside of or adhered to walls forming a cavity area in an exterior surface of front panel 68. Alternatively, drawer pull 69 comprises a knob, flange, or other projection that attaches to front panel 68 to provide a grip surface to user.

In one embodiment, front panel 68 includes a lock 73, as illustrated, for instance, in FIG. 4, for securing product 12 and/or other items within main drawer 46. Lock 73 includes a barrel 75, a locking mechanism 77, and a mating surface or mating mechanism 81. Barrel 75 extends through front panel 68 and includes a keyhole 71 exposed on an exterior surface of front panel 68. Locking mechanism 77 extends from an interior surface of front panel 68 into drawer compartment 44. Mating mechanism 81 is mounted to internal light drawer 48. In an embodiment, when a corresponding key is inserted into keyhole 71, locking mechanism 77 engages with mating mechanism 81. In this way, storage area 63 can remain inaccessible even when main drawer 46 is pulled out to an open position.

Figure 8:
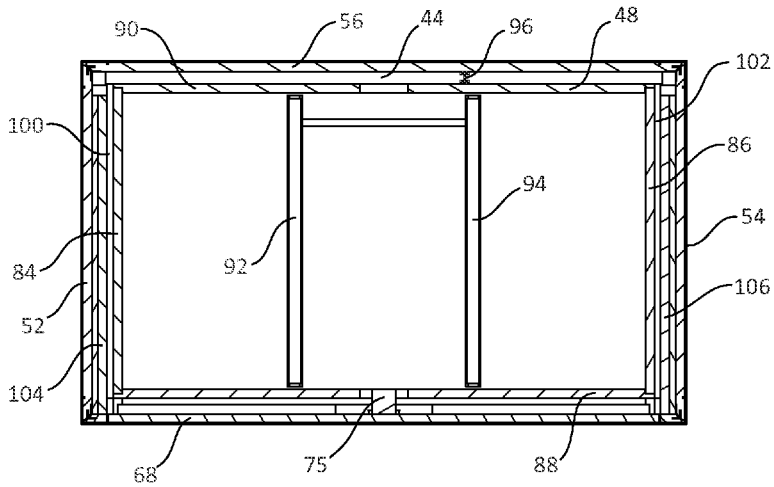
FIG. 8 is a cross-sectional view illustration of FIG. 4 taken along line 8-8, according to one embodiment of the present invention.
Figure 9:
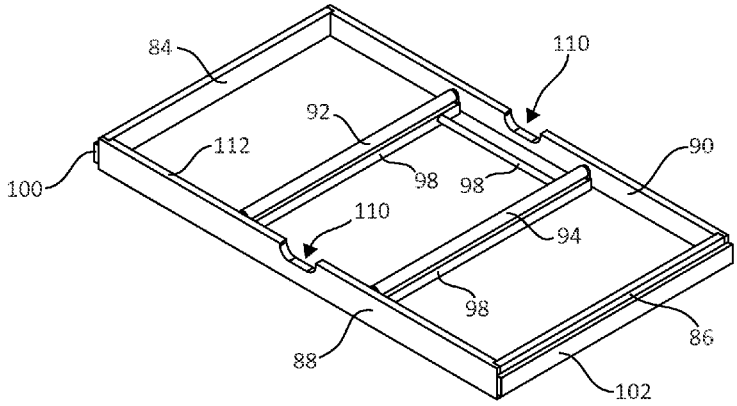
FIG. 9 is a perspective view illustration of an internal light drawer of FIG. 8, according to one embodiment of the present invention.
Figure 10:
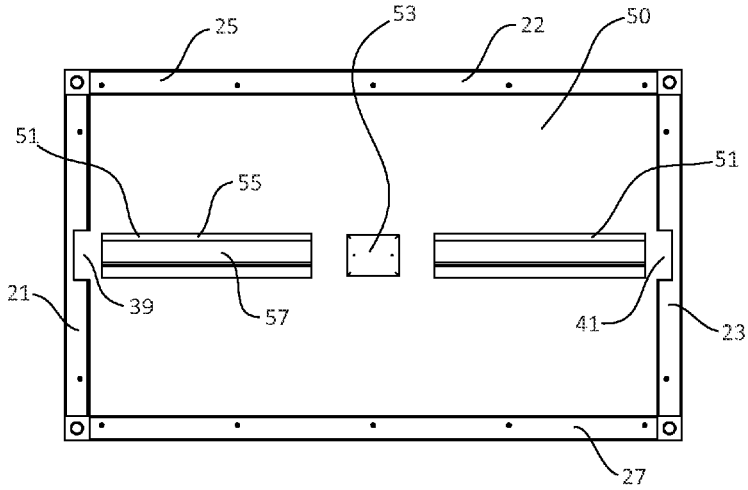
FIG. 10 is a bottom view illustration of a drawer compartment of the display table of FIG. 4, according to one embodiment of the present invention.

Referring now to FIGS. 4, 8, and 9, internal light drawer 48 includes a bottom panel 82, two opposing sidewalls 84 and 86, a front wall 88, and a back wall 90. Bottom panel 82 is substantially planar, and sidewalls 84 and 86 and walls 88 and 90 extend from bottom panel 82 to form an open top and a shallow, open cavity for containing light fixtures 92 and 94. Bottom panel 82 is depicted as substantially rectangular in FIGS. 8 and 9. In other embodiments, bottom panel 82 has a different shape.

To accommodate internal light drawer 48 within main drawer 46, each of a total height of sidewall 84 of internal light drawer 48 and sidewall 60 of main drawer 46 and a total height of sidewall 86 of internal light drawer 48 and sidewall 62 of main drawer 46 is less than a height of front opening 85. In this way, both main drawer 46 and internal light drawer 48 can be simultaneously pulled out from drawer compartment 44 if desired. Although sidewalls 84 and 86 of internal light drawer 48 are depicted as being shorter in height than sidewalls 60 and 62 of main drawer 46, relative heights of the sidewalls 60, 62, 84, and 86 depend on a desired depth for internal light drawer 48 and/or main drawer 46. For instance, in embodiments in which a deeper internal light drawer 48 is desired, sidewalls 84 and 86 may be taller than sidewalls 60 and 62. Regardless, a top edge of front wall 88 of internal light drawer 48 extends below a topmost edge of front panel 68 to conceal internal light drawer 48 when main drawer 46 is closed.

Internal light drawer 48 is configured to be capable of being pulled at least partially out of drawer compartment 44 when main drawer 46 is in one of its various open positions. In this regard, internal light drawer 48 includes railing sets each having glides 100 and 102 and railings 104 and 106. The glides 100 and 102 can be attached to opposing sidewalls 84 and 86 at positions above glides 70 and 72 and can be slidably coupled to corresponding railings 104 and 106 attached to interior surfaces of drawer compartment sidewalls 52 and 54 above railings 74 and 76. Suitable types of glide/railing sets 100, 102, 104, and 106 include ball bearing railings, linear slide rails, rack slide rails, and the like.

When main drawer 46 is fully extended, internal light drawer 48 can move between a retracted (i.e., closed) position and various extended (i.e., open) positions. To prevent hyperextension of internal light drawer 48, glide/railing sets 100, 102, 104, and 106 include locking mechanisms. Additionally, in one example, a stop mechanism 108 is included in the drawer compartment 44 to maintain a gap 96 between back wall 90 and back sidewall 56 to obstruct movement of the internal light 48 within main compartment 44. For example, stop mechanism 108 extends from bottom wall 50 of drawer compartment 44. In one embodiment, stop mechanism 108 extends from back wall 90 of internal light drawer 48 toward back sidewall 56 of drawer compartment 44. In another example, stop mechanism 108 couples to and extends from back sidewall 56 of drawer compartment 44 toward back wall 90 of internal light drawer 48. Stop mechanism 108 can comprise one or more plates, rods, and the like.

To improve a user's grip on internal light drawer 48, front wall 88 of internal light drawer 48 includes a cutout 110. Although cutout 110 is depicted as extending downwardly into front wall 88 from a top edge 112 of front wall 88, cutout 110 alternatively can be formed as an opening through front wall 88. For ease of manufacture, back wall 90 can also or alternatively include cutout 110 as well.

Figure 11:
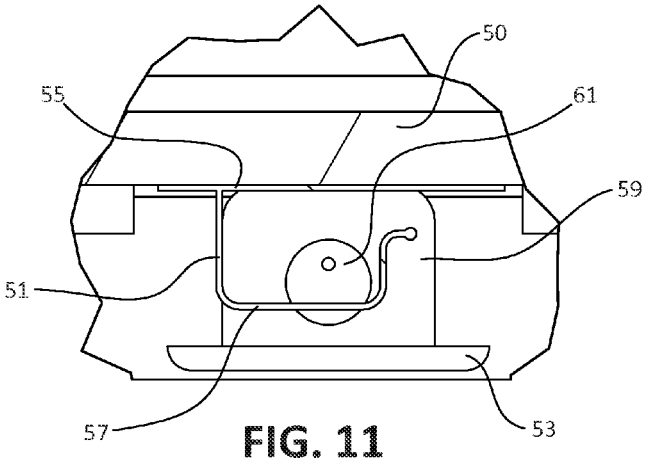
FIG. 11 close-up view illustration of the bottom of the drawer compartment of FIG. 4 taken along section 11, according to one embodiment of the present invention.
Figure 12:
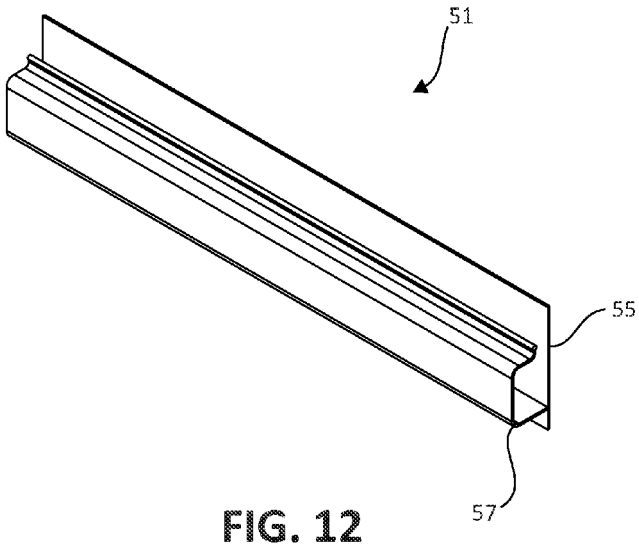
FIG. 12 is a front, perspective view illustration of a wire manager, according to one embodiment of the present invention.

In one embodiment, light fixtures or lighting fixtures 92 and 94 attach to one or more of bottom panel 82 and sidewalls 84, 86, 88, and 90. Light fixtures 92 and 94 include one or more components suitable for providing illumination, including but not limited to fluorescent light bulbs, light emitting diodes (LEDs), light strips, and the like. Depending on a particular configuration, light fixtures 92 and 94 can extend from front wall 88 of internal light drawer 48 to back wall 90. For example, a fluorescent light bulb comprising a tube extends between front and back walls 88 and 90 (as illustrated in FIGS. 11 and 12) or between sidewalls 84 and 86. In another example, LEDs, which comprise a string of lights, extend from front wall 88 to back wall 90 or between sidewalls 84 and 86. Alternatively, light fixtures 92 and 94 extend from one or more walls 84, 86, 88, and 90 to another one or more of walls 84, 86, 88, and 90 or along any of the walls. Light fixtures 92 and 94 preferably are spaced apart from each other to optimize distribution of the light. Although two light fixtures are shown, fewer or more light fixtures can be included in other embodiments.

An electrical conduit 98 extends under and between light fixtures 92 and 94 to guide wires to an opening (not shown) formed in bottom panel 82 of internal light drawer 48. In one embodiment, electrical conduit 98 is formed from one or more tubes comprising insulated material and the like. The wires can run through the bottom panel opening (not illustrated) and into gap 96 between back wall 90 of internal light drawer 48 and back sidewall 56 of drawer compartment 44. In an embodiment, gap 96 is smaller than gap 80. In other embodiments, gap 96 is substantially equal to or larger than gap 80. In one example, wire extends from gap 96 to gap 80 and into wire managers 51.

In one embodiment, display table 10 includes various features to conceal wires within display table 10. In one example, returning to FIGS. 5 and 6, support frame 22 is configured to provide openings for running wires under drawer section 16. In this regard, support frame 22 includes notches 39 and 41 formed on interior edges 31, 33, 35, and 37 of one or more of rails 21, 23, 25, and 27. For example, notches 39 and 41 are formed one each on opposing side rails 21 and 23. In another example, notches 39 and 41 are each formed on front rail 25 and back rail 27. In another embodiment, notches 39 and 41 are formed on a single rail 21, 23, 25, and 27. Although the figures show two notches 39 and 41, more or fewer are included in other embodiments. Additionally, although notches 39 and 41 are depicted as each having a generally rectangular outline, one or both notches 39 and 41, alternatively, have a different outline, such as semi-circular, semi-ovular, and the like, and/or are configured differently from each other.

With reference to FIGS. 4 and 10-12, bottom wall 50 conceals wires from internal light drawer 48 to improve visual appearance of display table 10. In one example, bottom wall 50 includes one or more wire managers 51 and a flange 53 mounted to a bottom surface 34 of bottom wall 50. Wire managers 51 extend at least partially across bottom surface 34 of bottom wall 50. For example, as illustrated in FIGS. 8 and 9, one end of a wire manager 51 aligns with a first notch 39 in support frame 22, while an end of another wire manager 51 aligns with a second notch 41 in support frame 22. Although two wire managers 51 are illustrated, fewer or more than two wire managers 51 are included in alternate embodiments.

Each wire manager 51 has an attachment panel 55 that attaches wire manager 51 to a desired surface such as bottom surface 34 of bottom wall 50. Attachment panel 55 can be nailed, tacked, pinned, adhered, or otherwise secured to the desired surface. An extension portion 57 extends along a length of attachment panel 55 and maintains wires in the wire manager 51. As illustrated in FIG. 12, extension portion 57 has a J-shaped side cross-section providing an opening for access to the wires. In other embodiments, wire manager 51 comprises a different type of managing mechanism, including, but not limited to a basic race wire manager, flexible tube, extruded grommet, brush strip, and the like.

Flange 53 is disposed between two wire managers 51 to receive wires from one or both managers 51. Flange 53 organizes an extra length of the wires and allows the wires to extend and retract as desired by a user. In this regard, as illustrated with additional reference to FIG. 11, flange 53 comprises a spool 59 around which the additional length of the wire is wound. Flange 53 also includes a spring mechanism 61 for retracting the additional length onto spool 59 as desired.

Figure 13:
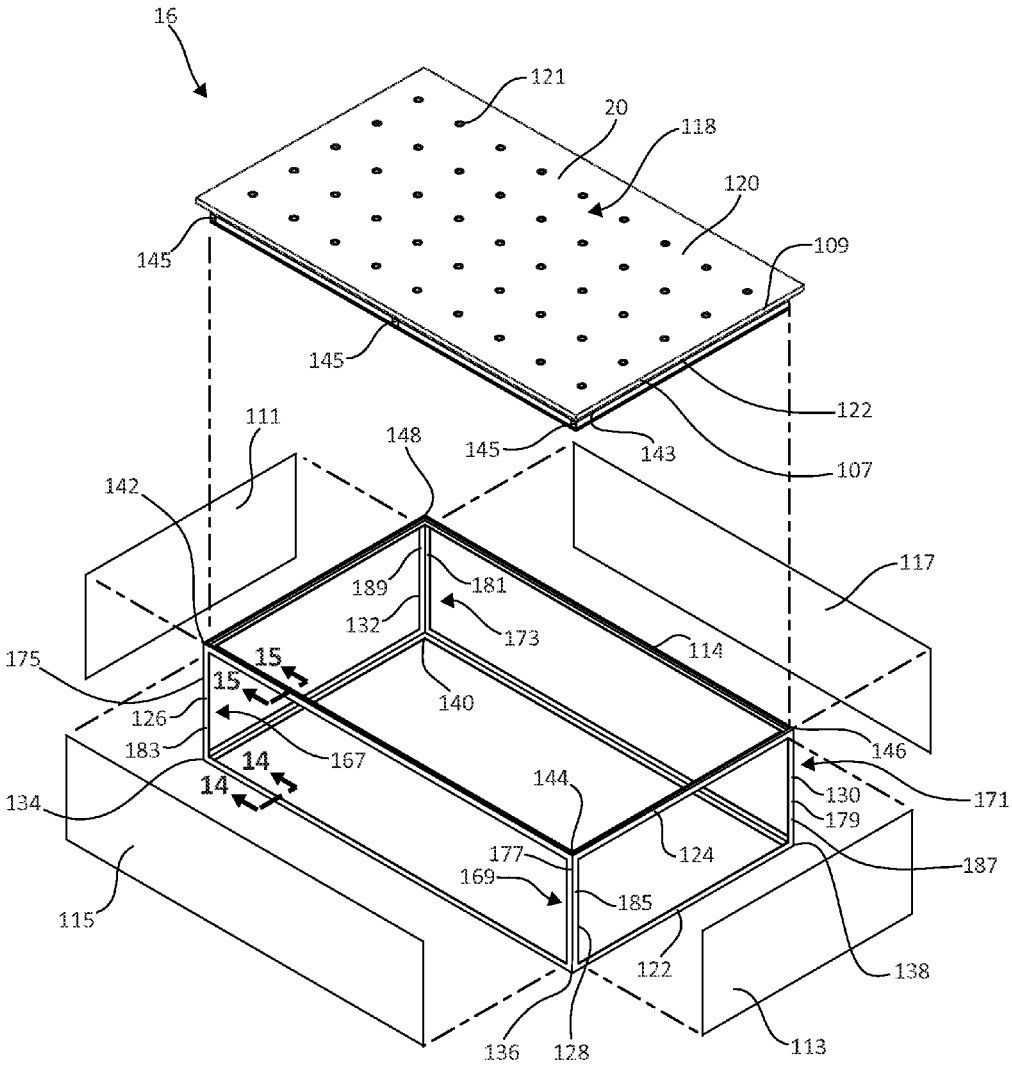
FIG. 13 is an exploded view illustration of an upper section of the display table, according to one embodiment of the present invention.

With reference to FIGS. 4 and 13, upper section 18 is configured to be illuminated by light from internal light drawer 48 and to provide a surface on which product 12 is displayed. In this regard, upper section 18 has an open bottom and is disposed over and receives light from internal light drawer 48. Consequently, upper section 18 is set over and supported by drawer section 44.

In an embodiment, upper section 18 includes a modular frame 114, translucent sidewalls 111, 113, 115, and 117, and a top planar assembly 118. Modular frame 114 provides structure to upper section 18 and comprises a material for providing structural integrity for display table 10. Suitable materials include, but are not limited to, metal, such as steel, aluminum, and the like, plastic, or any other material. In an embodiment, modular frame 114 is formed from a single piece of material. In another embodiment, components of modular frame 114 are welded or otherwise coupled to one another to form a unitary structure.

Modular frame 114 includes a bottom rail 122, a top rail 124, and side rails 126, 128, 130, and 132. Bottom rail 122 is disposed below top rail 124, and remains open toward internal light drawer 48 to allow light therefrom to illuminate translucent sidewalls 111, 113, 115, and 117. Side rails 126, 128, 130, and 132 extend from bottom rail 122 to top rail 124. According to an embodiment, such as that illustrated in FIG. 13, bottom and top rails 122 and 124 are rectangular, and side rails 126, 128, 130, and 132 each extend from one corner 134, 136, 138, and 140 of bottom rail 122 to a corresponding corner 142, 144, 146, and 148 of top rail 124. In other embodiments, one or both of bottom and top rails 122 and 124 has a different shape, such as ovular, circular, square, triangular, or another polygonal shape. In such case, more or fewer side rails are employed to connect bottom rail 122 to top rail 124.

Translucent sidewalls 111, 113, 115, and 117 are made of acrylic, plastic or another material capable of allowing light to pass through. In an embodiment, translucent sidewalls 111, 113, 115, and 117 are shaped to correspond with side openings formed by bottom and top rails 122 and 124 and side rails 126, 128, 130, and 132. Translucent sidewalls 111, 113, 115, and 117 are substantially rectangular to cover the side openings. In other embodiments, translucent sidewalls 111, 113, 115, and 117 have a different shape such as circular, ovular, square, or another polygonal shape. In still other embodiments, although four translucent sidewalls 111, 113, 115, and 117 are depicted in FIG. 13, more or fewer translucent sidewalls can be included depending on the shape of side openings formed by modular frame 114. Additionally, although translucent sidewalls 111 and 113 and translucent sidewall 115 and 117 have different shapes and sizes, translucent sidewalls 111, 113, 115, and 117 may be substantially equally sized, in other embodiments.

One or more of translucent sidewalls 111, 113, 115, and 117 are generally a single color or multiple colors, in an embodiment. Alternatively or additionally, one or more of translucent sidewall 111, 113, 115, and 117 include designs or indicia that draw attention to display table 10. For example, one or more of translucent sidewalls 111, 113, 115, and 117 include brand indicia, indicia indicating a sale or clearance item, colorful designs, patterns, and/or the like.

Top planar assembly 118 includes a top support member or top planar support member 120 and a dust tray 122. Top planar support member 120 is substantially rectangular and includes exposed, top surface 20, which as briefly mentioned above, is configured to provide a display surface for product 12. An outermost edge 107 of top planar support member 120 includes a groove 109 that engages with modular frame 114 to maintain top planar assembly 118 in position on top rail 124.

In one embodiment, top planar support member 120 is configured so that light does not directly illuminate product 12 displayed on display table 10. According to an embodiment, top planar support member 120 comprises an opaque material, in an embodiment. With additional reference to FIGS. 1 and 4, apertures 121 are formed through top planar support member 120 for retaining display stands 123, 125, 127, 129, and 131. In an embodiment, apertures 121 each comprise an opening 133 and a channel 135. Opening 133 is formed at top surface 20 and extends a particular depth into top planar support member 120 that is less than a length of channel 135. In an embodiment, opening 133 has a largest diameter that is larger than a largest diameter of channel 135. In this way, display stands 123, 125, and 127 having insertion rods that can be partially inserted into channel 135 (e.g., display stands 123, 125, and 127 having insertion rods 137, 139, and 141 with square cross sections) or those having circular cross sections (e.g., display stands 129 and 131) that can be fully inserted into apertures 121 can be included on a single display table. In other embodiments in which display stands having a single type of insertion rod are employed, opening 133 and channel 135 are substantially equal in largest diameter.

In an embodiment, apertures 121 are evenly spaced across top planar support member 120. In an example, apertures 121 form rows and columns. Although five rows and seven columns are shown, more or fewer are included in other embodiments. In another embodiment, apertures 121 are arranged in a different pattern. For example, apertures 121 can be disposed in concentric circle patterns, zigzag patterns, or form other designs. In still another embodiment, apertures 121 are formed randomly across top planar support member 120.

In some configurations, some apertures 121 are not used for holding display stands. To prevent objects or particles from falling into internal light drawer 48, dust tray 122 is disposed beneath top planar support member 120, as illustrated in FIGS. 4 and 13. Dust tray 122 has outer edge dimensions that do not extend beyond an outermost edge 107 of top planar support member 120. Although shown as being generally rectangular, dust tray 122 can have any other configuration that substantially covers apertures 121. Regardless of configuration, dust tray 122 is spaced apart from and coupled to a bottom surface 143 of top planar support member 120. According to an embodiment, attachment features 145 extend downwardly from top planar support member 120, and dust tray 122 is attached to attachment features 145. In another embodiment, attachment features 145 extend from dust tray 122 and engage with mount features (not shown) that are disposed on bottom surface of top planar support member 120. In any case, dust tray 122 is preferably selectively detachable from top planar support member 120 so that when top planar assembly 118 is removed from modular frame 114, objects and/or particles can be easily removed by cleaning dust tray 122. In an example, attachment features 145 include a sliding mechanism that allows dust tray 122 to attach and detach from top planar support member 120. In another example, attachment features 145 include another type of mounting mechanism.

Figure 14:
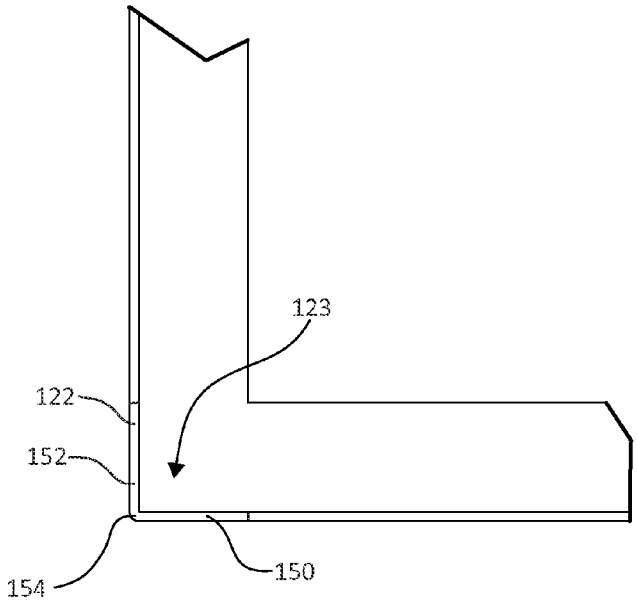
FIG. 14 is a cross-sectional view illustration of a bottom rail of the upper section of the display table of FIG. 13 taken along line 14-14, according to one embodiment of the present invention.
Figure 15:
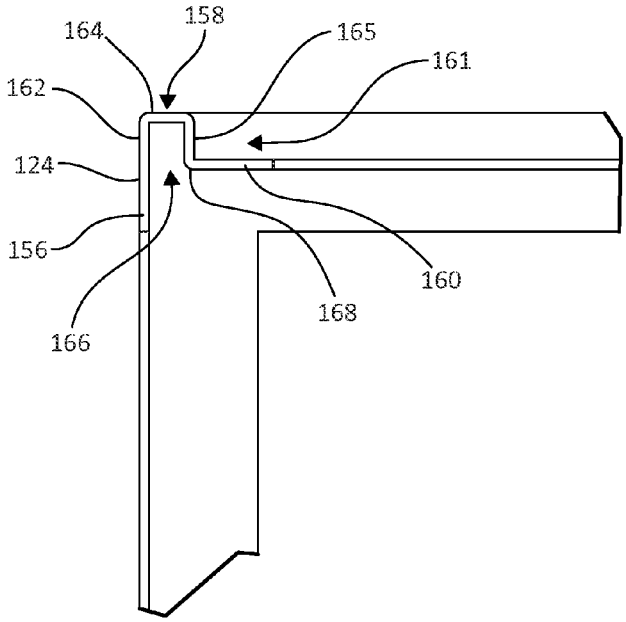
FIG. 15 is a cross-sectional view illustration of a top rail of the upper section of the display table of FIG. 13 taken along line 15-15, according to one embodiment of the present invention.

To maintain translucent sidewalls 111, 113, 115, and 117 in position, various retention features are included in modular frame 114. With additional reference to FIGS. 14 and 15, for example, bottom rail 122 defines a substantially L-shaped bottom shelf 123, top rail 124 includes a sidewall-retaining gap 166, and side rails 126, 128, 130, and 132 define sidewall corners 167, 169, 171, and 173 (FIG. 13). Bottom shelf 123 is formed from a bottom planar portion 150 and a vertical portion 152 extending upwardly from an outermost edge 154 of bottom planar portion 150. Bottom planar portion 150 and vertical portion 152 are substantially equal in width (e.g., each measured from outermost edge 154). In another embodiment, bottom planar portion 150 and vertical portion 152 are unequal in width. Bottom planar portion 150 is disposed substantially perpendicular to vertical portion 152, in an embodiment. In other embodiments, bottom planar portion 150 and vertical portion 152 are disposed at a substantially non-perpendicular angle relative to each other.

Sidewall-retaining gap 166 is defined by a vertical portion 156 of top rail 124, a top lip 158, and a top planar portion 160 of top rail 124. Vertical portion 156, which defines an outermost edge 162 of top rail 124, a topmost edge 164 of top rail 124 extending from outermost edge 162, and a lip wall 165 extending downwardly from topmost edge 164 define top lip 158 and sidewall-retaining gap 166. Vertical portion 156 and lip wall 165 are suitably dimensioned to provide space for an edge of one or more translucent sidewalls 111, 113, 115, and 117 to be disposed therein when translucent sidewall 116 rests on bottom shelf 123. Accordingly, sidewall-retaining gap 166 is preferably greater than a thickness of translucent sidewall 116.

Returning to FIG. 13, sidewall corners 167, 169, 171, and 173 each have an L-shaped cross section formed from a first side length 175, 177, 179, and 181 and a second side length 183, 185, 187, and 189. First side lengths 175, 177, 179, and 181 extend from second side length 183, 185, 187, and 189 and are disposed substantially perpendicular thereto, in an embodiment. In another embodiment, first side lengths 175, 177, 179, and 181 and a second side length 183, 185, 187, and 189 are disposed at a non-substantially perpendicular angle relative to each other.

By including the above-described retention features, the topmost edge of each translucent sidewall 111, 113, 115, and 117 is disposed in sidewall-retaining gap 166, and the bottommost edge of each translucent sidewall 111, 113, 115, and 117 rests on bottom shelf 123. Side edges of translucent sidewall 111 rest inside sidewall corners 167 and 169, respectively, side edges of translucent sidewall 113 rest inside sidewall corners 169 and 171, respectively, side edges of translucent sidewall 115 rest inside sidewall corners 171 and 173, respectively, and side edges of translucent sidewall 117 rest inside sidewall corners 173 and 169, respectively.

Modular frame 114 also includes retention features for suspending top planar assembly 118 over drawer section 114. With additional reference to FIG. 15, in an embodiment, outermost edge 107 of top planar support member 120 rests on a top shelf 161 and dust tray 122 extends below top shelf 161. Top shelf 161 is formed by top planar portion 160, which extends inwardly from top lip 158. According to an embodiment, top planar portion 160 is disposed substantially perpendicular to lip wall 165. In another embodiment, top planar portion 160 is disposed at non-substantially perpendicular angle relative to lip wall 165. Depending on a desired depth of top shelf 161, in one embodiment, top planar portion 160 is wider than lip wall 165 (e.g., each length measured from edge 168). In another embodiment, top planar portion 160 has substantially the same width or is thinner than lip wall 165.

To display product using display table 10, product 12 is placed on top planar support member 120, for example, by using one or more display stands 123, 125, 127, 129, and 131. As shown in FIG. 1, for example, one or more insertion rods 137, 139, and 141 of display stands 123, 125, 127, 129, and 131 are inserted into apertures 121 in top planar support member 120. After display stands 123, 125, 127, 129, and 131 are secured to display table, product 12 may be hung from display stands. To draw attention to display table 10, plug (not shown) of light fixtures 92 and 94 is plugged into an electrical socket, and light fixtures 92 and 94 are powered on. Consequently, light fixtures 92 and 94 emit light illuminating upper section 18 and translucent sidewalls 111, 113, 115, and 117 through the open bottom of upper section 18.

Over time, light fixtures 92 and 94 may need maintenance. In this regard, with reference to FIG. 17, a user grips drawer pull 69 to slide main drawer 46 forward into an open position. If main drawer 46 is locked, pulling main drawer 46 to the open position also causes internal light drawer 48 to slide forward to an open position as well.

Figure 17:
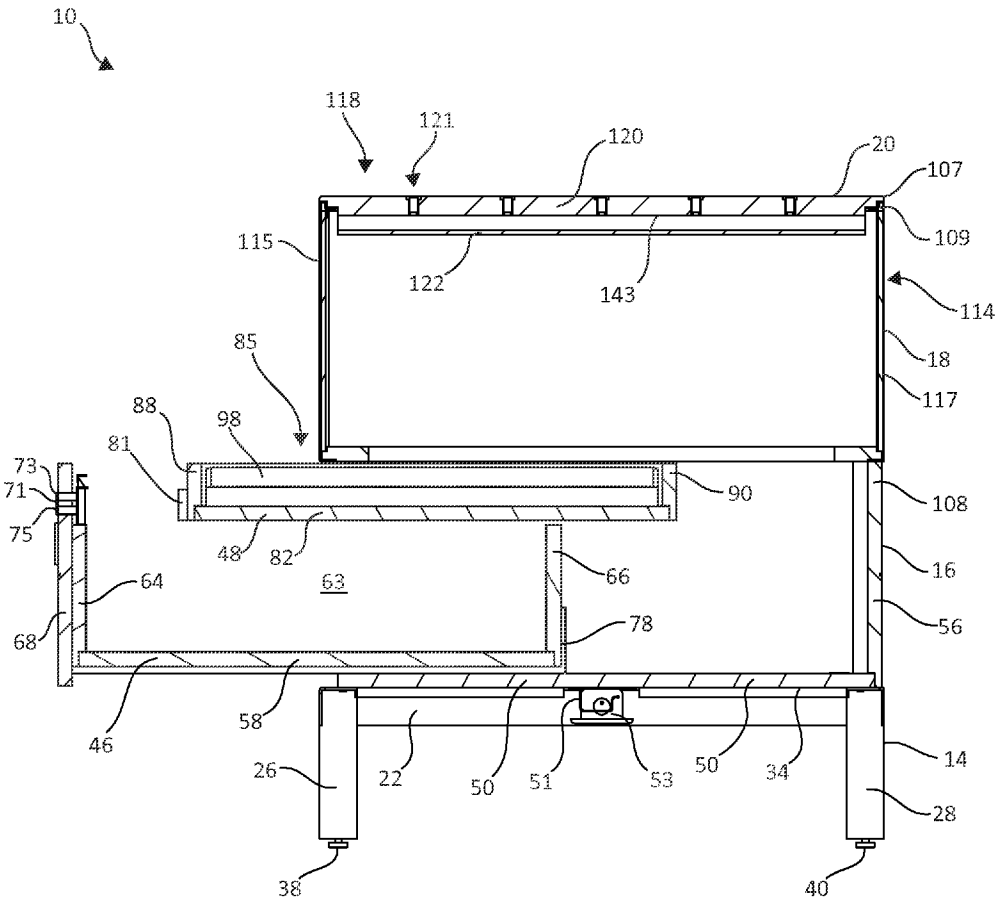
FIG. 17 is the cross-sectional view illustration of FIG. 16 with the main drawer in an open position and the internal light drawer in a closed position, according to one embodiment of the present invention.
Figure 18:
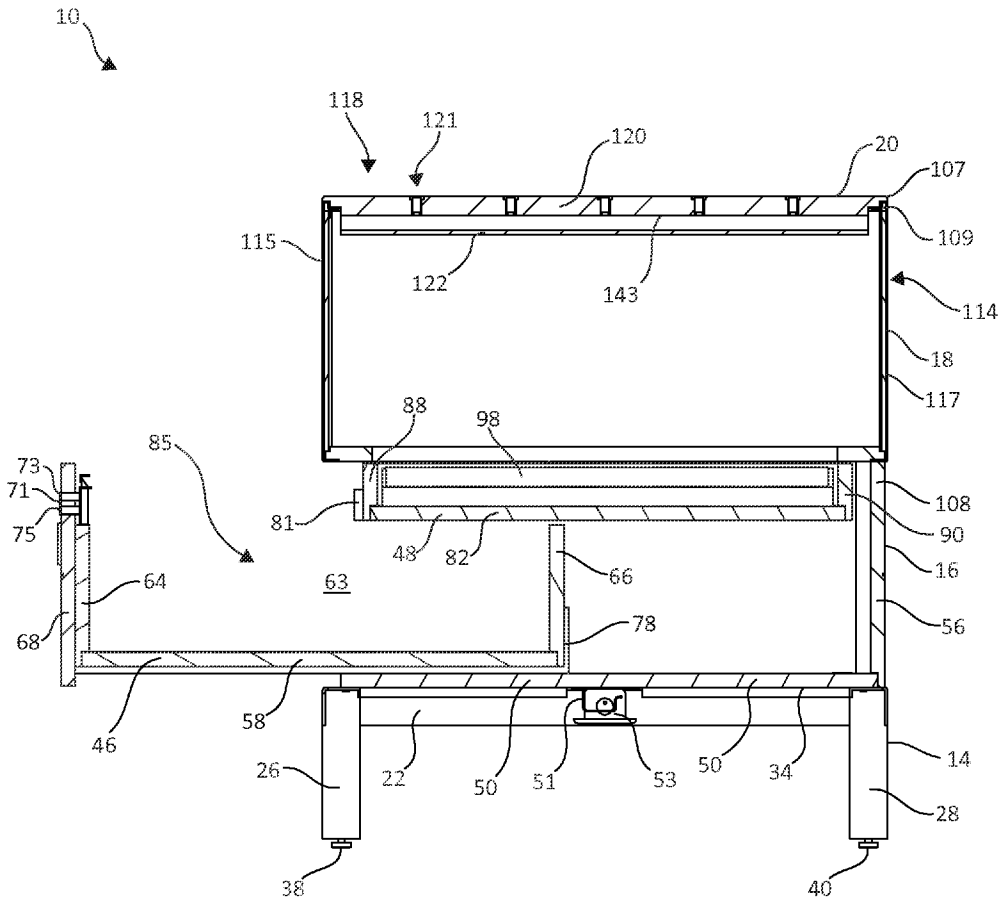
FIG. 18 is the cross-sectional view illustration of FIG. 16 with the main drawer in an open position and the internal light drawer in a partially open position, according to one embodiment of the present invention.

Product 12 and/or supplies for maintaining light fixtures 92 and 94 may be disposed in main drawer 46, and thus, the user may need to access main drawer 46. To open a locked main drawer 46, the user inserts a key into keyhole 71 to unlock locking mechanism 77. If main drawer 46 is in the closed position, the user grips drawer pull 69 to slide main drawer 46 forward and internal light drawer 48 remains at least partially in drawer compartment 44. If main drawer 46 is in an open position, the user slides internal light drawer 48 backwards to a partially open (as shown in FIGS. 17) or closed position (as shown in FIG. 18) to expose storage area 63 of main drawer 46. If main drawer 46 is not locked, the user simply slides internal light drawer 48 relative to main drawer 46 to expose storage area 63 of main drawer 46.

A lighted retail display has now been provided with a light access drawer that is hidden from view and easy to access during maintenance periods. By positioning the light access drawer over the main drawer, allowing the two drawers to be movable relative to each other, and including a locking mechanism between the two drawers, light fixtures within the light access drawer can be replaced and/or repaired while the storage area of the main drawer remains inaccessible.

Although the invention has been described with respect to particular embodiments, such embodiments are meant for illustrative purposes only and should not be considered to limit the invention. Various alternatives and changes will be apparent to those of ordinary skill in the art. Other modifications within the scope of the invention and its various embodiments will be apparent to those of ordinary skill.

What is claimed is:

1. A display table comprising:

a drawer section including two opposing sidewalls partially defining a drawer compartment and a main opening;

a main drawer disposed within the drawer compartment slidably mounted to the two opposing sidewalls, the main drawer including an exposed front panel configured to substantially conceal the main opening of the drawer component;

an internal light drawer disposed above the main drawer and slidably coupled to the two opposing sidewalls; and an upper section disposed over the drawer section to receive light when the internal light drawer is illuminated, wherein:

the main drawer is configured to move between an open position and a closed position, when the main drawer is in the open position, the internal light drawer is movable relative to the main drawer, and when the main drawer is in the closed position, the internal light drawer is concealed by the exposed front panel.

2. The display table of claim 1, wherein the upper section includes a top planar member that is opaque.

3. The display table of claim 1, wherein the internal light drawer has a front wall with a top edge that is positioned below a topmost edge of the exposed front panel.

4. The display table of claim 3, wherein:

the internal light drawer further comprises a bottom panel, a back wall, and two light drawer sidewalls extending from the bottom panel to form an open cavity between the front wall, the back wall, and the two light drawer sidewalls; and the display table further comprises a lighting fixture placed within the open cavity and extending between the front wall and the back wall.

5. The display table of claim 4, further comprising an electrical conduit extending along the bottom panel, wherein the lighting fixture includes wires disposed in the electrical conduit.

6. The display table of claim 1, wherein the internal light drawer includes a lighting fixture comprising at least one of a fluorescent light bulb and an LED.

7. The display table of claim 1, wherein:

the main drawer has a first set of glides;

the internal light drawer has a second set of glides; and the drawer section further comprises railings corresponding to the first and second sets of glides, each railing disposed on an interior surface of the two opposing sidewalls of the drawer section.

8. The display table of claim 7, wherein:

the railings of the drawer section include a first set of railings corresponding to the first set of glides and a second set of railings corresponding to the second set of glides;

the first set of railings is attached to the interior surface of the two opposing sidewalls of the drawer section at a first location; and the second set of railings is attached to the interior surface of the two opposing sidewalls of the drawer section at a second location above the first location.

9. The display table of claim 1, wherein:

the upper section includes a plurality of translucent sidewalls, a top planar assembly, and an open bottom.

10. The display table of claim 9, wherein:

the upper section includes a modular frame having a bottom rail, a top rail, and side rails;

the side rails extend between the bottom rail and the top rail to form side openings; and the plurality of translucent sidewalls is disposed over the side openings.

11. The display table of claim 9, wherein:

the top planar assembly further comprises a top planar member and a dust tray;

the top planar member has a plurality of apertures extending therethrough; and the dust tray is disposed below the plurality of apertures of the top planar member and configured to catch particles that fall through the plurality of apertures.

12. The display table of claim 1, further comprising a base on which the drawer section is disposed.

13. A display table comprising:

means for enclosing;

means for storing product and hiding the product from view, the means for storing product being movable between an open position extending from the means for enclosing and a closed position being positioned substantially within the means for enclosing;

means for illuminating disposed over the means for storing product and independently slidably movable relative to the means for storing product when the means for storing product is in the open position, the means for illuminating being hidden from view when the means for storing product is in the closed position; and means for displaying product, the means for displaying being disposed over the means for illuminating.

14. The display table of claim 13, wherein when the means for storing is in the open position, the means for illuminating is movable between a retracted position and an extended position.

15. The display table of claim 13, wherein the means for displaying includes a translucent panel that is configured to be illuminated by the means for illuminating.

16. The display table of claim 13, wherein the means for displaying includes a top planar support member including a plurality of apertures formed therethrough.

17. The display table of claim 16, further comprising means for catching particles that have fallen through one or more apertures of the plurality of apertures.

18. The display table of claim 13, further comprising means for elevating the means for storing product.

19. The display table of claim 13, wherein:

the means for illuminating comprises a drawer including light fixtures mounted to the drawer.

20. A method of displaying a product, the method comprising:

displaying the product on a display table including a drawer section, a main drawer, an internal light drawer, and an upper section, wherein the drawer section defines a main compartment enclosing the main drawer and the internal light drawer, the internal light drawer is disposed over the main drawer, the main drawer is configured to move between an open position and a closed position, the internal light drawer is movable relative to the main drawer when the main drawer is in the open position, and the internal light drawer is inaccessible when the main drawer is in the closed position; and illuminating the upper section with light fixtures disposed in the internal light drawer.

21. The method of claim 20, further comprising sliding the main drawer to the open position and moving the internal light drawer to expose a storage area in the main drawer.

22. A display table comprising:

a base;

a lower section disposed over the base and including a bottom wall, two opposing sidewalls, and a back sidewall, the two opposing sidewalls and the back sidewall extending from the bottom wall to form a compartment;

a first drawer disposed in the compartment and having an exposed front panel with a topmost edge, the first drawer defining a storage area and being movable between an open position during which the first drawer is extended at least partially out of the compartment and a closed position during which the first drawer is substantially positioned within the compartment;

a first set of glides attached to the first drawer;

a first set of railings attached at a first position on interior surfaces of the two opposing sidewalls, the first set of railings corresponding to the first set of glides;

a second drawer disposed in the compartment and having a light fixture disposed therein, the second drawer positioned over the first drawer and having a front wall with a top edge extending below the topmost edge of the exposed front panel to thereby hide the second drawer from view when the first drawer is in the closed position;

a second set of glides attached to the second drawer;

a second set of railings attached at a second position on the interior surfaces of the two opposing sidewalls, the second position being above the first position, and the second set of railings corresponding to the second set of glides; and an upper section disposed over the lower section for receiving light from the light fixture of the second drawer.

23. The display table of claim 22, further comprising a locking mechanism mounted to the exposed front panel to mate with a mating surface on the second drawer to conceal the storage area when the first drawer is in the open position.

24. The display table of claim 22, wherein:

the second drawer defines an open top;

the upper section includes an opening and a plurality of translucent sidewalls;

the opening is disposed over the lower section; and light from the light fixture within the second drawer is transmitted through the plurality of translucent sidewalls.

* * * * *